United States Patent [19]

MacAskill et al.

[11] Patent Number: 4,682,082

[45] Date of Patent: Jul. 21, 1987

[54] GAS DISCHARGE LAMP ENERGIZATION CIRCUIT

[75] Inventors: Robert B. MacAskill, Bay Village; Jeffrey J. Braun, Parma, both of Ohio

[73] Assignee: The Scott & Fetzer Company, Cleveland, Ohio

[21] Appl. No.: 734,546

[22] Filed: May 16, 1985

[51] Int. Cl.[4] ..... H05B 41/14

[52] U.S. Cl. ..... 315/219; 315/206; 315/208; 315/209 R; 315/DIG. 5; 315/DIG. 7; 313/619

[58] Field of Search ..... 315/206, 219, 208, 209 R, 315/DIG. 7, DIG. 5, 278, 224; 313/619

[56] References Cited

U.S. PATENT DOCUMENTS

| | | | |
|---|---|---|---|
| 4,042,852 | 8/1977 | Zaderej et al. | 315/97 |
| 4,463,286 | 7/1984 | Justice | 315/DIG. 7 |
| 4,492,899 | 1/1985 | Martin | 315/308 |
| 4,544,863 | 10/1985 | Hashimoto | 315/209 R |
| 4,581,562 | 4/1986 | Nilssen | 315/219 |
| 4,587,461 | 5/1986 | Hanlet | 315/DIG. 7 |
| 4,588,924 | 5/1986 | Luursema et al. | 315/DIG. 7 |

*Primary Examiner*—David K. Moore
*Assistant Examiner*—M. Razavi
*Attorney, Agent, or Firm*—Pearne, Gordon, McCoy & Granger

[57] ABSTRACT

An electronic energization circuit is provided to illuminate a gas discharge lamp that includes a transformer with a substantially rectangular hysteresis loop. A secondary winding on the transformer is connected to energize the lamp and at least one primary winding is provided on the transformer. Input voltage terminals may be DC terminals to supply an input voltage to the circuit. At least one semiconductor, such as a transistor, is connected to the input terminals and to the at least one primary winding, and a control means is provided for the semiconductor for unequal on and off conduction periods of the semiconductor. These unequal periods provide the conditions which eliminate the striations (bubbles) or dark spots in the gas plasma of the lamp, usually associated with high frequency energization. When two semiconductors are used in a circuit, they conduct alternately in a type of square wave oscillator circuit and the duty cycle of the two transistors is different so that the striations in the illumination of the lamp are eliminated. The foregoing abstract is merely a resume of one general application, is not a complete discussion of all principles of operation or applications, and is not to be construed as a limitation on the scope of the claimed subject matter.

16 Claims, 9 Drawing Figures

GAS DISCHARGE LAMP ENERGIZATION CIRCUIT

BACKGROUND OF THE INVENTION

Gas discharge lamps, such as neon lamps, have in the past been energized by a line frequency voltage source operating through a step-up transformer which has usually been termed a "ballast." In such prior art circuits, the transformer has been operating at line frequency, typically 50 or 60 hertz, and this necessarily means a physically large and bulky transformer with a considerable amount of iron to carry this low frequency flux.

Fluorescent lamps have been operated on high frequency, e.g., 24 kHz, as shown in U.S. Pat. No. 4,042,852. This permits the use of a much smaller physical size of transformer or ballast, because not as much iron is required for high frequency operation. This circuit required a relatively high-power starter circuit utilizing a thyristor. When this high frequency type of circuit is attempted to be used on a gas discharge lamp, such as a neon lamp, as distinguished from a fluorescent lamp, striations or bubbles in the gas plasma within the lamp are formed, which have been found to be objectionable from a visibility and marketing standpoint. These striations are produced in the high frequency circuits for fluorescent lamps, but since fluorescent lamps have an internal coating, such striations are masked. Also, in such prior art circuits, there was provided a full-wave, two-transistor oscillator to supply the primary of the transformer, and the drive was balanced, which we have found to produce striations if the circuit were to be used on a gas discharge lamp such as a neon lamp.

SUMMARY OF THE INVENTION

The problem to be solved, therefore, is how to energize a gas discharge lamp such as a neon lamp with high frequency yet to avoid striations or bubbles in the gas plasma within the lamp.

This problem is solved by an electronic energization circuit for a luminous gas discharge lamp comprising, in combination, a transformer having a generally rectangular hysteresis loop, at least one primary winding on said transformer, secondary winding means on said transformer having an output connectable to said lamp, input terminals for supplying a voltage to said electronic energization circuit, a first semiconductor connected to said at least one primary winding and to said input terminals, and means to establish a control for said semiconductor for unequal on and off times of said semiconductor.

The problem is further solved by an electronic energization circuit for a luminous gas discharge lamp comprising, in combination, a transformer having a generally rectangular hysteresis loop, at least one primary winding on said transformer, secondary winding means on said transformer having an output connectable to said lamp, input terminals for supplying a voltage to said electronic energization circuit, a first and a second semiconductor connected to said input terminals and to said at least one primary winding for current flow therein in opposing directions, and means to establish a control for said semiconductors for unequal duty cycles of said semiconductors.

Accordingly, an object of the invention is to provide an electronic energization circuit for a luminous gas discharge lamp which eliminates striations or bubbles in the lamp.

Another object of the invention is to provide a solid state energization circuit for a gas discharge lamp wherein a semiconductor supplies energy to a transformer with a generally rectangular hysteresis loop and in which there are unequal on and off times of the semiconductor.

Another object of the invention is to provide a single semiconductor energization circuit for a gas discharge lamp.

A further object of the invention is to provide a solid state energization circuit for a gas discharge lamp with first and second oppositely conducting semiconductors supplying energy through a rectangular hysteresis loop transformer to the lamp, and with the two semiconductors having unequal conduction periods.

Other objects and a fuller understanding of the invention may be had by referring to the following description and claims, taken in conjunction with the accompanying drawing.

DETAILED DESCRIPTION OF THE PREFERRED EMBODIMENTS

Figure 1:
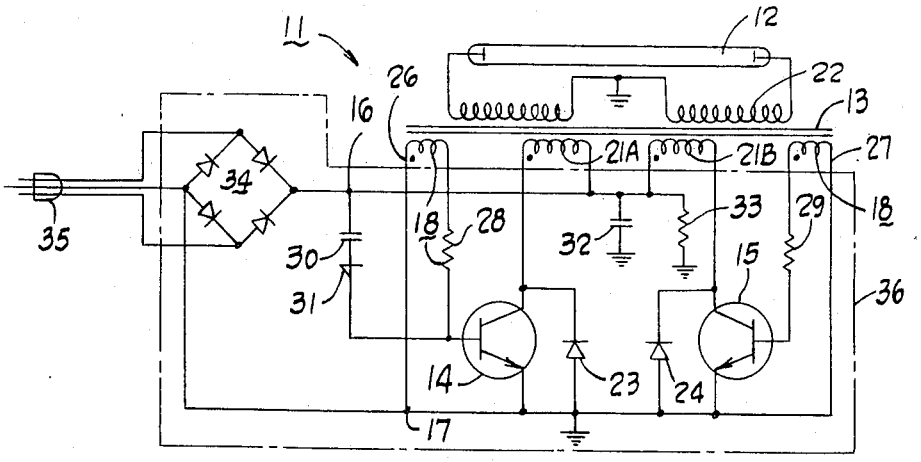
FIG. 1 is a schematic diagram of a two-transistor energization circuit for lamp energization.
Figure 2:
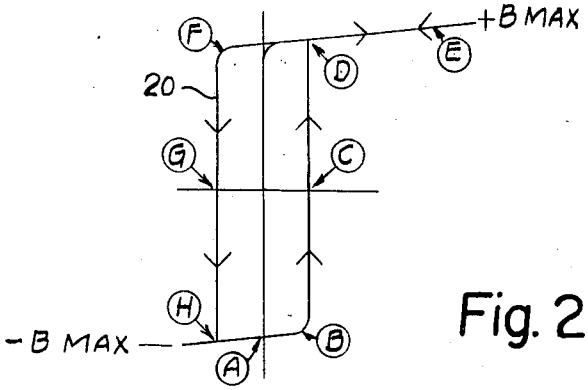
FIG. 2 is a drawing of a rectangular hysteresis loop of the operation of the transformer core.

FIG. 1 is a schematic diagram of an electronic energization circuit 11 which is operable to energize a luminous gas discharge lamp 12. The energization circuit 11 includes generally a transformer 13, first and second semiconductors 14 and 15, voltage input terminals 16 and 17, and control means 18 for the semiconductors 14 and 15. The transformer 13 is one which has a generally rectangular hysteresis loop 20, as shown in FIG. 2. In FIG. 1, this transformer is shown as having a primary winding 21 and a secondary winding 22. The primary winding is split into two coils 21A and 21B with the interconnection of these two coils connected to voltage input terminal 16. These two primary coils are preferably bifilar wound, to aid in reducing damaging voltage spikes and reducing primary leakage reactance. The secondary winding 22 is center-tapped and grounded at this center tap as a safety precautions to lower the voltage, relative to ground, for the terminals of the secondary winding. The lamp 12 is connected across the outer terminals of the secondary winding 22, and this may be one of many different types of gaseous discharge lamps, e.g., those with a neon gas filling.

The semiconductors 14 and 15 may be FET's, SCR's, Triacs or GTO devices, but are shown as transistors, each with collector, base and emitter. The collector of transistor 14 is connected through the primary winding 21A to the voltage input terminal 16, and the emitter of this transistor is connected to the voltage input terminal 17, which in this circuit is grounded. A high-speed diode 23 is connected in opposition across the collector and emitter terminals of the transistor 14 to quickly dissipate the energy in the inductive primary winding 21A. The semiconductor 15 has a similar connection, with the collector thereof connected through the primary winding 21B to the voltage input terminal 16 and with the emitter connected to the voltage input terminal 17. A high speed diode 24 is also connected in opposition across this emitter and collector.

The control means 18 controls the on-times and off-times of the semiconductors 14 and 15. This control means may take many forms, but in this case is shown as a trigger circuit. The control means provides means to establish desired conduction of the semiconductors 14 and 15. This control means includes first and second control windings 26 and 27 on the transformer 13. The first control winding 26 is connected through a current limiting resistor 28 between the base of the transistor 14 and ground terminal 17. Similarly, the second control winding 27 is connected through a current limiting resistor 29 between the base of the transistor 15 and the ground terminal 17. A start circuit is provided by a capacitor 30 and a diac 31 connected in series between the terminal 16 and the base of transistor 14. A filter capacitor 32 and resistor 33 help smooth the applied voltage. The voltage input terminals 16 and 17 preferably are unidirectional voltage terminals and, as shown in FIG. 1, a bridge rectifier 34 supplies a full wave rectified voltage to the terminals 15 and 16 from an alternating voltage source 35 represented by a cord and plug set.

The start or phase of each of the controlled and primary windings is shown by a dot at one end of the respective winding, and this refers to the fact that when the dot end of a primary winding is positive, for example, the voltage induced on the transistor bases by control windings 26 and 27 will also be positive at their dot end but 180 degrees out of phase with each other.

Figure 3:
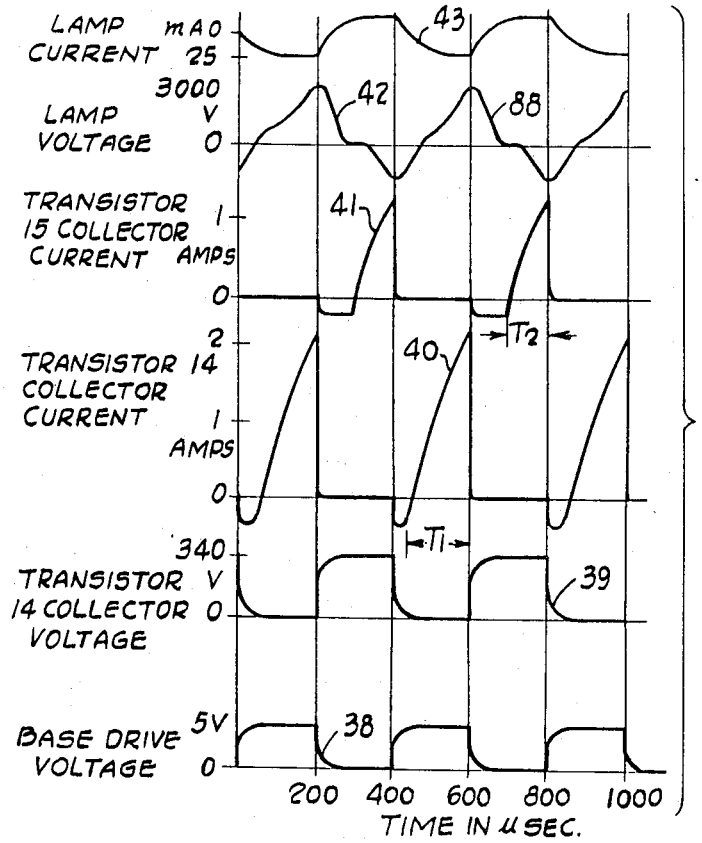
FIG. 3 is a series of voltage and current waves illustrating operation of the circuit of FIG. 1.

FIGS. 2 and 3 illustrate the operation of the circuit of FIG. 1. In FIG. 3, curve 38 illustrates the positive voltage pulses applied to the base of the transistor 15. This turns on the transistor in synchronism therewith so that curve 39 shows the voltage across the collector and emitter of the transistor 14. This voltage is pulled down to near zero when the base is positive. Curve 40 is the collector current which flows through the primary winding 21A. Curves 42 and 43 show the lamp voltage and current, respectively. Curve 41 is the curve of collector current of the transistor 15, and this transistor alternates in conduction with transistor 14. This circuit 11 may be considered generally a square wave oscillator circuit, and in this preferred embodiment, the conduction times of the two transistors is unequal, in order to get rid of the striations or bubbles in the gas discharge lamp. The operation of the circuit of FIG. 1 is similar to the operation of a Royer oscillator. This is a single transformer, square-wave power oscillator converter. A somewhat similar circuit is shown in U.S. Pat. No. 4,042,852. Such a circuit may be quite satisfactory for many applications, even including fluorescent lamps, as shown in the aforesaid patent. However, such fluorescent lamps utilize a fluorescent coating on the inside of the transparent envelope of the lamp and such fluorescent coating masks the striations which have been found to occur in the neon gas plasma at high frequency operation. In some of the literature, these striations 45 have been referred to as "bubbles," "sausages" or "beads," and they appear to be separated by nodes 46 in the light-emitting plasma within the lamp.

The shape of the magnetic hysteresis loop of the core of the transformer 13 is shown in FIG. 2. The core 13 provides the necessary coupling between the primary and secondary windings, and also helps in determining the operating frequency. At time zero on curve 38, it will be considered that the transistor 15 has been conducting, and that the base voltage on transistor 14 suddenly becomes positive. This causes the collector current to start to flow, and on FIG. 2, the operating point moves from point A to B.

As current increases, the operating point moves up the hysteresis curve from points B to D at a constant rate of change of flux density b, the latter being determined by the LR time constants of the circuit. The collector current curve 40 is curved, somewhat like the curve of charging voltage on a capacitor. With the unidirectional power source, it will be assumed that the voltage on the primary winding remains constant. During this time, the power is delivered to the secondary winding at a current level determined by the transformer characteristics and impedance of the secondary circuit.

As the collector current moves the operating point of the transformer core to the point D on the hysteresis curve, the dB/dt suddenly drops to near zero. The transformer is then in saturation at point E on FIG. 2. When dB/dt drops, so does $V_{b-1}$, the base voltage on transistor 14. This casues the collector current in the base drive to drop to zero. With the collapse of the flux, the transistor 14 turns off and, with the sudden change in collector current, a back EMF is generated to induce a positive voltage on the second control winding 27, turning transistor 15 on. As the collector current in transistor 15 increases, the operating point of the core moves from D, through F and G, to H on the hysteresis curve, generating a positive and constant voltage on the primary winding 21B because of the constant dB/dt. When the operating point reaches point H on the hysteresis curve, dB/dt collapses, reversing the action again.

It will be noted in FIG. 3 that the first transistor 14 has a period $T_1$, a time period of conduction which is longer than the period $T_2$, the time period of conduction of transistor 15. This has been purposely established by the control means 18 in order to eliminate the striations or bubbles in the gas discharge lamp.

Figure 5:
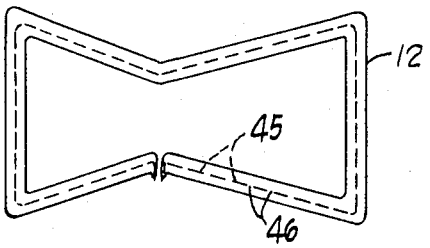
FIG. 5 is a plan view of a lamp showing striations.

FIG. 5 illustrates the gas discharge lamp when operated on a square-wave oscillator circuit similar to FIG. 1, and when the two semiconductors have substantially equal duty cycles. In such case, the luminous plasma has segments or bubbles 45 where the plasma is illuminated or giving off light and has dark spots which appear to be nodes 46 in the plasma where there is no or little illumination. These illuminated portions 45 move lengthwise along the lamp 12, or they may stand still or reverse direction. In any event, they are objectionable from a marketing standpoint and the customers appear to prefer the usual appearance of a neon lamp, i.e., one which has continuous illumination, as was provided by the low frequency or power line frequency energization by the older gas discharge lamp ballasts.

Figure 6:
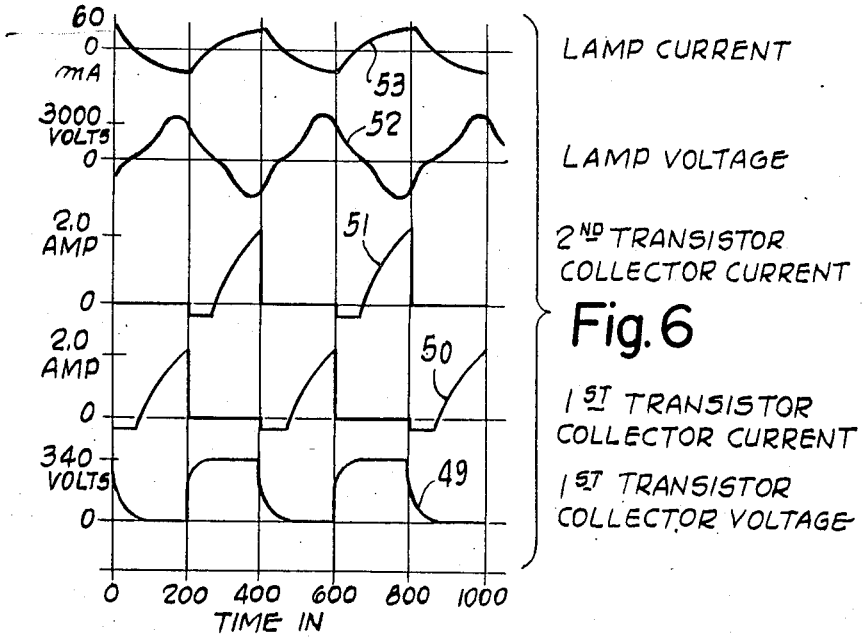
FIG. 6 is a graph of current and voltage waves explaining balanced operation.

FIG. 6 illustrates various operational curves of a generally balanced square wave oscillator circuit. This may be the circuit 11 when operated at approximately equal duty cycles for each of the two semiconductors 14 and 15. Curve 49 is the curve of the voltage across the collector and emitter of the first transistor 14. The curve of the voltage across the collector and emitter of the second transistor 15 would be shifted in phase by 180 degrees from this curve 49. Curve 50 is a curve of the collector current through the first transistor 14, and curve 51 is a curve of the collector current through the second transistor 15. Curve 52 is a curve of the lamp voltage, and curve 53 is a curve of the lamp current.

Equation 1 shows how the voltage on the primary $V_p$ is derived and sustained.

Equation 1 is the expression for primary winding voltage impressed on the transformer core during the transition from B to D and D to H on the hysteresis loop of the transformer core (FIG. 2.)

$$Vp = N_{p1}\, Ac \frac{(dB)}{dt} \times 10^{-8} \text{ volts} \qquad \text{(Eq. 1)}$$

Where:

$N_{p1}$, number of primary turns on winding 21A

Ac, cross section area of core dB/dt, Instantaneous rate of change of magnetic flux density Vp, Instantaneous primary voltage Because $N_{p1}$ and Ac are fixed, Vp remains constant, a substantially rectangular wave, when dB/dt remains constant.

The operating point moves from $-B_{max}$ to $+B_{max}$ and back to $-B_{max}$ in a cyclical fashion and at a prescribed frequency as shown in Equation 4. The time, ΔT, required to move from $-B_{max}$ to $+B_{max}$ is $$\Delta T = \frac{\Delta B\, Np\, Ac \times 10^{-8}}{Vcc - 1} \qquad \text{(derived from Eq. 1)}$$

$$\Delta B = 2\, B_{max} \text{ and } \Delta T = \frac{T}{2}. \qquad \text{(Eq. 2)}$$

$$\text{Then } \frac{T}{2} = \frac{2\, B_{max}\, Np\, Ac \times 10^{-8}}{Vcc - 1}.$$

The operating frequency $$f = \frac{1}{T} = \frac{Vcc - 1 \times 10^{8}}{4\, B_{max}\, Np\, Ac} \text{ Hz.} \qquad \text{(Eq. 3)}$$

Eq. 3 restated, $$f = \frac{(Vcc - 1) \times 10^{8}}{4\, B_{max}\, Np\, Ac} \text{ Hz.} \qquad \text{(Eq. 4)}$$

Since all of the elements of (Eq. 4) are constant, f is constant and varies only if there is ripple on the supply voltage Vcc.

If substantially balanced operation of the circuit of FIG. 2 is used, as shown in FIG. 6, this causes the beads of light to appear in the gas discharge lamp as shown in FIG. 5. Applicants have discovered that operating the circuit of FIG. 1 in an unbalanced manner can eliminate the appearance of the striations. The striations may still be present, but the retentivity of the observer's eye makes the beads 45 of light all blend together so that there are no dark spots 46 in the gas plasma. To achieve this unbalanced operation, the control means 18 controls the transistors 14 and 15 for unequal current conduction times. This may be provided by different voltages from the control windings 26 and 27, but in the preferred embodiment is accomplished by different values of current limiting resistors 28 and 29. For example, resistor 28 may be 12 ohms and resistor 29 may be 18 ohms, for a greater base drive of the transistor 14.

FIG. 3 illustrates operation of the circuit of FIG. 1 in accordance with the invention, and shows that the first transistor 14 is conducting for a time period T1, which is considerably in excess of the time period T2, the conduction period of the second transistor 15. In most cases, it has been found that with one transistor conducting for a period of about 10% more than the other, the visible appearance of the striations completely disappears. Even 5% more conduction time has been found to practically eliminate such striations. In FIG. 3, the conduction period of the first transistor 14 is about 170 microseconds, whereas the conduction period of the second transistor 15 is only about 110 microseconds, so that the first transistor has about a 50% incease of conduction period relative to the second transistor. It will be noted that the maximum value of the current of the first transistor is about double that of the second transistor, and on the hysteresis curve of FIG. 2 this means that the transformer core is driven much harder toward $+B_{max}$ than it is toward $-B_{max}$, and probably the operation of the transformer core just turns the knee of the curve at point H on this hysteresis curve, and then the flux starts to collapse.

Figure 4:
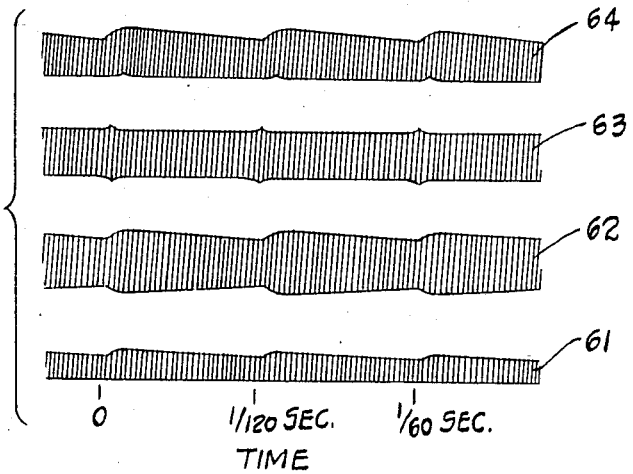
FIG. 4 is a graph of current and voltage waves of the supply voltage.

FIG. 4 illustrates voltage and current curves 61 to 64, respectively, with curve 61 showing the base to emitter voltage of the first transistor, curve 62 showing the collector current, curve 63 showing the voltage on half the secondary, and curve 64 showing the secondary current. All of these curves are shown over a longer time base to show the ripple in the power supply which has been purposely caused by utilizing a filter capacitor 32 which is smaller than normal. This not only saves money but it has been found to aid in reducing the striations in the gas discharge lamp 12. The secondary current shown by curve 64 shows that it varies about 25%. It might vary only about 10% if the circuit is lighly loaded or 25 to 30% if more heavily loaded.

This ripple in the power supply appears to achieve a smearing effect of the bubbles on the eye response. The eye retentivity appears not to notice those things occurring faster than about 1/20 second, so this ripple at 1/120 second helps to smear the bubbles to produce a more substantially uniform illumination of the gas discharge lamp.

Figure 7:
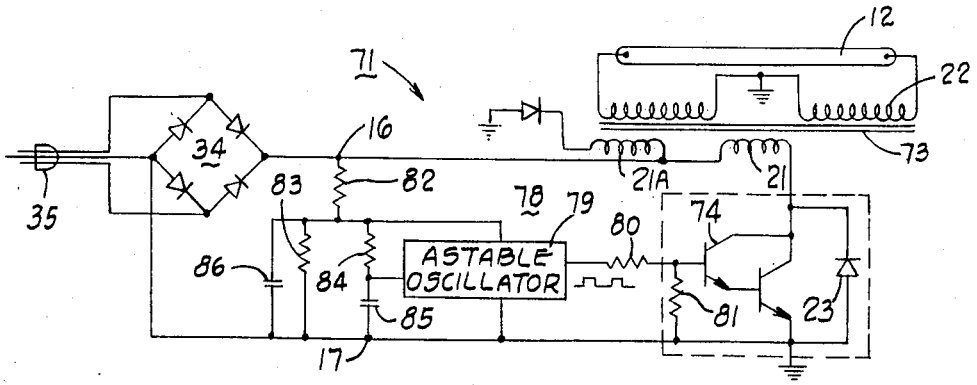
FIG. 7 is a schematic diagram of a single semiconductor circuit for lamp energization.

FIG. 7 is a schematic diagram of a single semiconductor circuit 71 for lamp energization. This circuit is similar to but simpler than the energization circuit 11 of FIG. 1. This circuit 71 is operable to energize the luminous gas discharge lamp 12, and includes generally a transformer 73, a semiconductor 74, voltage input terminals 76 and 77, and control means 78 for the semiconductor 74. The transformer 73 again has a generally rectangular hysteresis loop, and has a primary winding 21 and a secondary winding 22. The semiconductor 74 is preferably a Darlington-type with the two collectors connected through the primary winding 21 to the voltage input terminal 16. The emitter output of the transistor is connected to the voltage input terminal 17, and the base input of the transistor is connected to the control means 78. A high speed diode 23 is connected in opposition across the output of this semiconductor 74. The primary coil 21A is retained, together with a diode to ground, to help eliminate large voltage spikes during off times of the transistor.

The control means 78 controls the on-times and off-times of the semiconductor 74. The control means may take many forms, but in this case is shown as a pulse circuit or trigger circuit which includes an astable oscillator 79 having an output through a resistor 80 to the base input of the semiconductor 74. A resistor 81 is connected between this base input and the voltage input terminal 17. Voltage dropping resistors 82 and 83 are connected across the input terminals 16 and 17 and determine the voltage applied to the oscillator 79. An RC timing circuit includes a resistor 84 and capacitor 85 connected to the oscillator 79 to determine the square wave oscillating frequency thereof. A capacitor 86 helps filter the applied voltage to the oscillator 79. The oscillator may run at many different frequencies but preferably in the high frequency range, such as 3–20 kilohertz.

Figure 8:
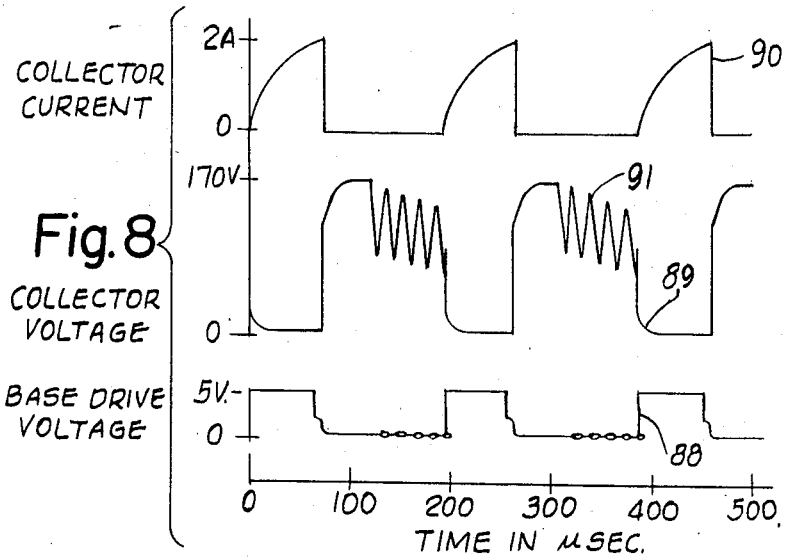
FIG. 8 is a graph of the current and voltage waves of the circuit of FIG. 7.

FIG. 8 shows the curves of the voltages and currents in the circuit of FIG. 7. The curve 88 shows the base drive voltage on the semiconductor 74. Curve 89 is the curve of the voltage across the transistor 74, and curve 90 shows the collector current. The base drive turns on the transistor 74 and the collector voltage drops toward zero. The collector current rises and the curve is generally similar to the curve of a charging voltage on a capacitor. As the current increases, the operating point moves up the hysteresis curve from C to D at a constant rate of change of flux density B with time. During this time, the power is delivered to the secondary winding to provide lamp voltage to illuminate the lamp 12. The transformer core is driven into saturation, and about at this point, the pulsing circuit of the control means 78 preferably has a duty cycle to turn off the base drive, so that the flux in the transformer core collapses. Curve 89 of the voltage across the transistor shows that this circuit rings or oscillates as the flux collapses, as shown at portion 91 of the curve 89. This ringing depends upon the damping factor of the lamp and secondary circuit during this portion 91 of the curve. The core operating point moves from D back to the origin on the hysteresis curve. The next time the base of the transistor is pulsed, this cycle starts over again.

The duty cycle of the transistor 74 is established so that it is not at the about fifty percent range in order to avoid the bubbles 45 in the neon lamp. Chart A is a charts of bubbles versus duty cycle for the circuit 71 of FIG. 7.

CHART A

| Duty Cycle % | Bubbles | |
|---|---|---|
| 20 | 0 | |
| 30 | 0 | |
| 40 | 0 | |
| 45 | 2 | Bubble Region[1] 48% ± 5 |
| 48 | 5 | |
| 50 | 3 | |
| 52 | 1 | |
| 55 | 0 | |
| 60 | 0 | |

[1]Testing was done at a 200 μs period, but perfomenace was not period-sensitive.

This Chart A shows that so long as the duty cycle was not within the range of 45 to 52 percent, then no bubbles were visible in the gas discharge lamp. The bubble region was found to occur when testing was done at a 200 microsecond period, but performance was not period-sensitive. The base drive was of the form shown in curve 88 in FIG. 8. When the duty cycle was 40 percent, quite satisfactory illumination of the neon lamp was achieved. As the duty cycle reduced toward 20 percent, the lamp was still bubble-free, but the lumen output decreased. The 20 percent duty cycle was quite satisfactory as an operating point, but the circuit conditions would have to be changed to achieve normal lamp brightness. As the duty cycle was operated at 55 percent, there were again no bubbles, but the lamp became too bright as one increased the percent duty cycle above this point. Again, the circuit constants would have to be changed to achieve normal lamp brightness.

Figure 9:
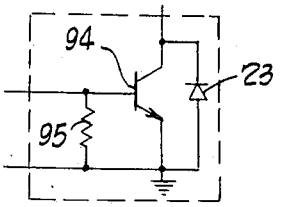
FIG. 9 is an alternative to the Darlington transistor of FIG. 7.

FIG. 9 shows an alternative to the Darlington transistor 74 in FIG. 7, and shows a power transistor 94. This transistor would again have the high speed diode connected in opposition and have a base-to-emitter resistor 95. This powered transistor will operate satisfactorily to replace the Darlington transistor in FIG. 7. However, it requires greater base drive and has greater loading on the power supply. Also, it will be appreciated that a Darlington circuit can be fabricated from two separate transistors, the output transistor being a power transistor and the input transistor being a medium high voltage, low-powered transistor, with the collector thereof returned to the voltage input terminal 16 or to the collector of the output transistor.

The electronic energization circuit 11 or 71 is operable at high frequency, e.g., in the range of kilohertz to tens of kilohertz, with 5 to 20 kilohertz being typical operating frequencies. Circuits 11 and 71 are adaptable to many different gas discharge lamps, e.g., advertising signs, which have different tube diameters, tube lengths, and gas pressure. Circuits 11 and 71 are capable of exciting the neon signs or gas lamps to conventional brightness and light uniformity. Typical prior art low frequency sign transformers weighed about 8 to 10 pounds, whereas the present circuit weighs less than 2 pounds, and does not need to be potted or encapsulated in order to properly operate. This low weight provides a low mechanical load to the frame of the sign; hence, shipping costs and sign damage are significantly reduced.

The materials and parts for energization circuits 11 and 71 are commercially available with no non-standard parts. Manufacturing requires only standard coil winding means and printed circuit assembly. The entire electrical circuit may be mounted on a printed circuit shown by the dot-dash outline 36 of FIG. 1. Alternatively, they may be incorporated in a single semiconductor chip. The two primary windings 21A and 21B are preferably wound on the same bobbin in a bifilar fashion to reduce primary leakage inductance and voltage spikes that would damage the transistors. Circuits 11 and 71 derive full wave rectified power from the 120-volt AC line without utilizing a costly transformer. When rectified and filtered, this gives about 170 volts at the voltage input terminals 16 and 17. The power supply filter 32 reduces the conducted RFI and allows a certain amount of ripple to aid in uniformly illuminating the gas lamp 12. There is a wide tolerance of component parameters, including transistor beta and base drives 28 and 29, without any deterioration in performance of the sign.

The efficiency of the prior art low frequency ballast was typically 30–40%, whereas the efficiency of the present circuit of FIG. 1 is about 88%. The circuits of FIGS. 1 and 7 have a low parts count, including the two active semiconductors operating at a low temperature, which provides safety and a long life. Control windings 26 and 27 are also wound in a bifilar fashion on the same bobbin with the primary windings. The two coils which make up the secondary winding 22 are preferably wound on separate bobbins realized safe center tap to increase the breakdown voltage and to insert some current ballasting secondary leakage inductance. Circuits 11 and 71 permit the internal gas pressure within the gas discharge lamp 12 to be reduced to about 50% of its normal value, as used with low frequency sources, and this also reduces light striations produced by the high frequency energy source, yet retains similar brightness to that in low frequency prior art sources.

Values of the circuit components in circuits which have operated satisfactorily according to the present invention are as follows:

| Resistors | | Diodes | |
|---|---|---|---|
| 28 | 12 ohms, ½ watt | 23, 24 | MR 856 |
| 29 | 18 ohms, ½ watt | 34 | MR 504 |
| 29 | 151 C, 2 watts | | Transformer |
| 33 | 100 kohms, 1 watt | | Core -Stackpole 50-0583 |
| 80 | 2.2 kohms | | Primary #24 wire, 170-volt |
| 81 | 100 ohms | | Secondary #34 wire, |
| 84 | 50 kohms | | 3000 v. each |
| 86 | 6800 ½ watt | | Control #24 wire |
| 95 | 100 ohms | | Diac |
| | Capacitors | 31 | In 5761 |
| 30 | .0015 μf, 600 volt | | Transistors |
| 32 | 48 μf, 250 volt | 14, 15 | MJ 13071 |
| 85 | .01 μf | 74 | Darlington config. |
| 86 | 10 μf, 16 volt | 94 | MJ 13071 |

One reason why the circuit of FIG. 1 eliminates the visible light striations is felt to be that because transistor 14 has a 50% longer conduction period than transistor 15, its effective frequency is about two-thirds that of transistor 15. With these two different effective operating frequencies, it is surmised that the dark spots 46 are smeared and moved along the length of the tube at two different frequencies. The retentivity of the eye makes it appear to be uniform illumination. In circuit 71 of FIG. 7, there are not two frequencies, yet the duty cycle being other than 50% apparently accomplishes the same visual result of lack of striations. The start circuit 28, 29 in FIG. 1 provides an initial base drive for the transistor 14 to provide a reliable start for the circuit when the circuit is first energized and when it is cold. Circuit 11 is essentially a rectangular voltage wave oscillator and is self-contained DC to a pulse power converter which requires no external circuit to drive it on and off. The number of turns on the control windings 26 and 27 are small so that characteristically there is a low impedance which will provide the necessary current to the transistors to put each transistor into saturation.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of the circuit and the combination and arrangement of circuit elements may be resorted to without departing from the spirit and the scope of the invention as hereinafter claimed.

What is claimed is:

1. An electronic energization circuit for a luminous gas discharge lamp comprising, in combination:

a transformer having a generally rectangular hysteresis loop;

at least one primary winding on said transformer;

secondary winding means on said transformer having an output connectable to said lamp;

input terminals for supplying a voltage to said electronic energization circuit;

a first semiconductor connected to said at least one primary winding and to said input terminals; and control means connected to said semiconductor to eliminate striations in the gas plasma within the lamp by establishing unequal on and off times of said semiconductor.

2. An electronic energization circuit as set forth in claim 1, wherein said semiconductor is a Darlington transistor.

3. An electronic energization circuit as set forth in claim 1, wherein said control means establishes a substantially rectangular wave voltage pulse on said at least one primary winding.

4. An electronic energization circuit as set forth in claim 1, wherein said control means is operable within a frequency range of 3–20 KHz.

5. An electronic energization circuit as set forth in claim 1, wherein said control means controls said semiconductor for said on time less than said off time.

6. An electronic energization circuit as set forth in claim 1, wherein said input terminals supply a full-wave rectified voltage to said electronic energization circuit.

7. An electronic energization circuit as set forth in claim 6, including means to only incompletely filter said full-wave rectified voltage so as to retain about 10% to 25% of the voltage fluctuations of said full-wave rectified voltage under lamp energization load.

8. An electronic energization circuit as set forth in claim 1, including a second semiconductor, and means connecting said second semiconductor to said input terminals and to said at least one primary winding for supplying a voltage pulse to said at least one primary winding.

9. An electronic energization circuit as set forth in claim 8, wherein said control means is connected to said second semiconductor for establishing unbalanced conduction of said semiconductors with said first semiconductor having a conduction period at least 10% longer than that of said second semiconductor.

10. An electronic energization circuit as set forth in claim 9, wherein said control means establishes the conduction period of said first semiconductor at least 20% longer than that of said second semiconductor.

11. An electronic energization circuit as set forth in claim 1, wherein the components are discrete devices mounted on a printed circuit board.

12. An electronic energization circuit as set forth in claim 1, wherein all components except the transformer are formed in a single semiconductor chip.

13. An electronic energization circuit for a luminous gas discharge lamp comprising, in combination:

a transformer having a generally rectangular hysteresis loop;

at least one primary winding on said transformer;

secondary winding means on said transformer having an output connectable to said lamp;

input terminals for supplying a voltage to said electronic energization circuit;

a first and a second semiconductor connected to said input terminals and to said at least one primary winding for current flow therein in opposing directions; and control means connected to said semiconductors to eliminate striations in the gas plasma within the lamp by establishing unequal on and off times of said semiconductors.

14. An electronic energization circuit as set forth in claim 13, including first and second interconnected primary windings on said transformer, said first and second semiconductors being connected to apply voltages in opposition to said first and second primary windings.

15. An electronic energization circuit as set forth in claim 14, wherein said control means includes a control winding on said transformer inductively coupled to said primary windings.

16. An electronic energization circuit as set forth in claim 13, wherein said control means controls said semiconductors for unequal conduction periods.

* * * * *